US005453022A

United States Patent [19]

Staiger et al.

[11] Patent Number: 5,453,022

[45] Date of Patent: Sep. 26, 1995

[54] ACTUATING DEVICE

[75] Inventors: Bruno Staiger, Erligheim; Helmut Rivinius; Jochen Welz, both of Bönnigheim, all of Germany

[73] Assignee: Steuerungstechnik Staiger GmbH & Co. Produktionsvertriebs AG, Erligheim, Germany

[21] Appl. No.: 201,363

[22] Filed: Feb. 24, 1994

[30] Foreign Application Priority Data

| | | | |
|---|---|---|---|
| Feb. 24, 1993 | [DE] | Germany | 43 05 544.3 |
| Jan. 11, 1994 | [DE] | Germany | 44 00 476.1 |
| Jan. 18, 1994 | [DE] | Germany | 44 01 202.0 |

[51] Int. Cl.[6] ..... H01R 4/24

[52] U.S. Cl. ..... 439/404; 439/413

[58] Field of Search ..... 439/271, 492, 439/395–404, 417–419, 341, 405, 495, 498, 499, 411–413

[56] References Cited

U.S. PATENT DOCUMENTS

| | | | |
|---|---|---|---|
| 4,286,835 | 9/1981 | Adams et al. | 439/76 |
| 4,508,399 | 4/1985 | Dowling et al. | 439/404 |
| 4,743,080 | 5/1988 | Siraty | 439/492 |
| 4,932,873 | 6/1990 | La Shier | 439/76 |
| 5,125,846 | 6/1992 | Sampson et al. | 439/404 |
| 5,204,805 | 4/1993 | Takahashi et al. | 439/76 |

*Primary Examiner*—David L. Pirlot
*Attorney, Agent, or Firm*—Michael J. Striker

[57] ABSTRACT

An actuating device has an actuator, at least one control conductor connected with the actuator, and at least one through connection useable without a tool and associated with the electrical actuator, the control conductor uninterruptibly contacting with the through connection.

38 Claims, 6 Drawing Sheets

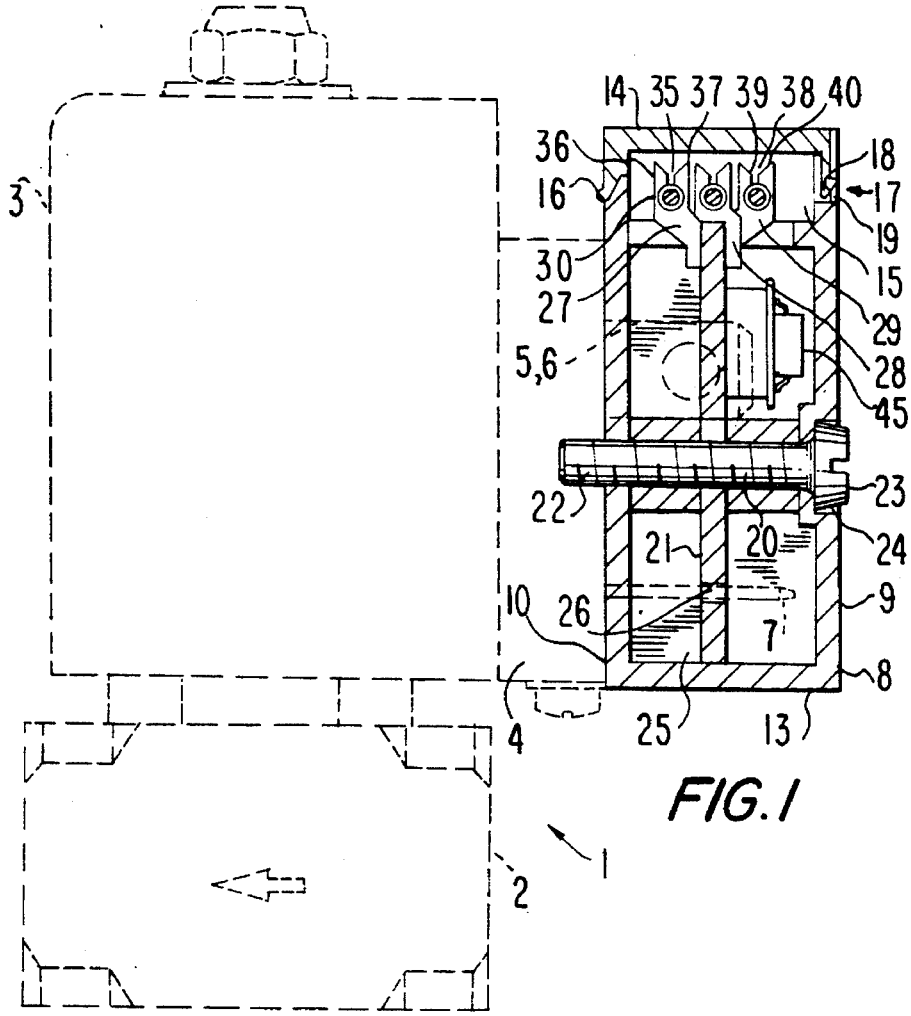
FIG. 1
FIG. 2
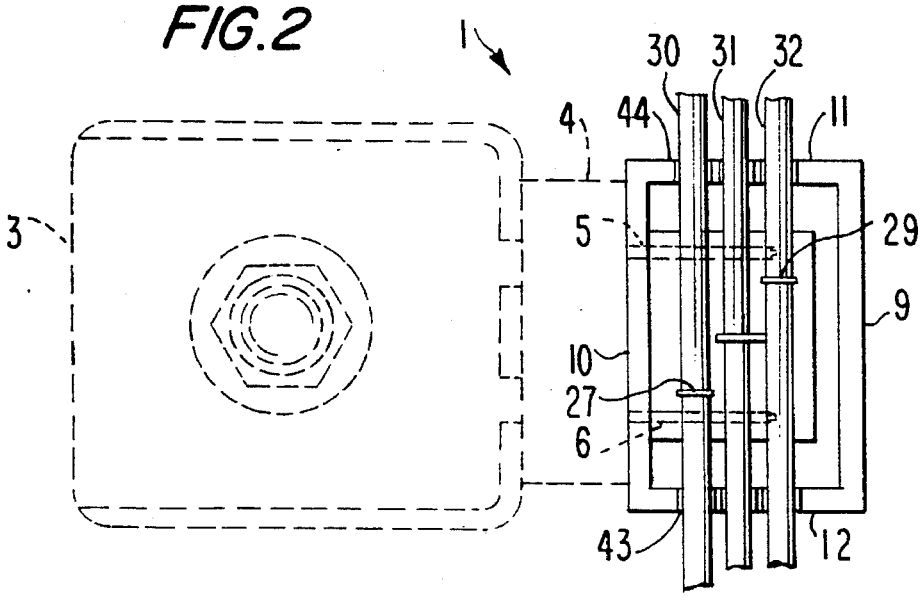

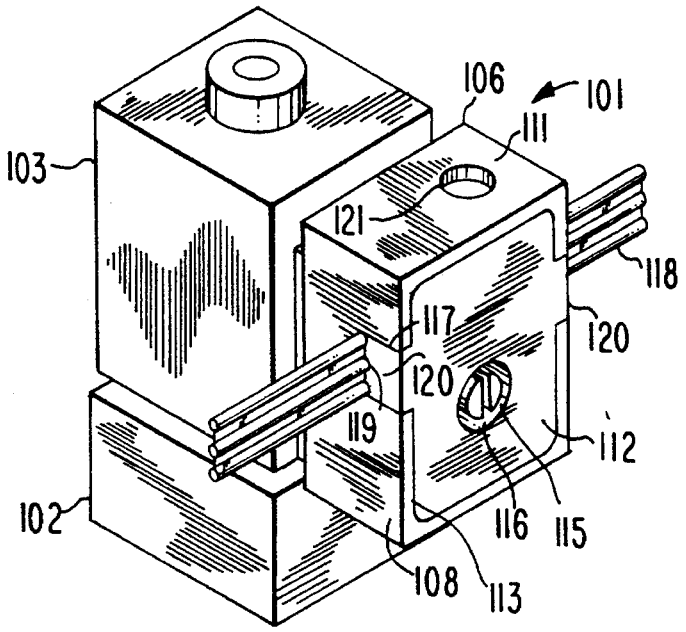
FIG.6
FIG.7
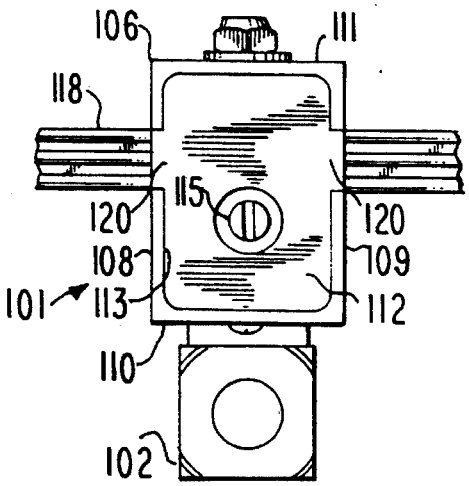
FIG.8
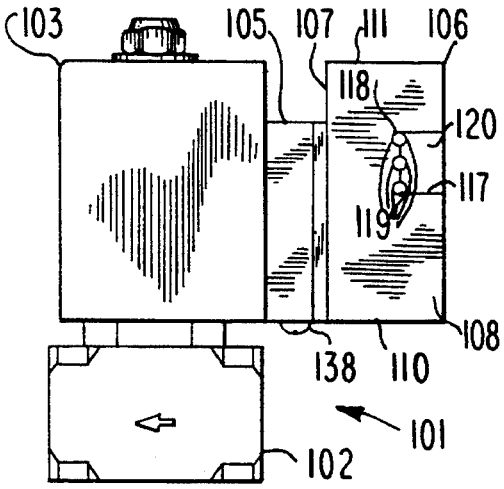
FIG.9
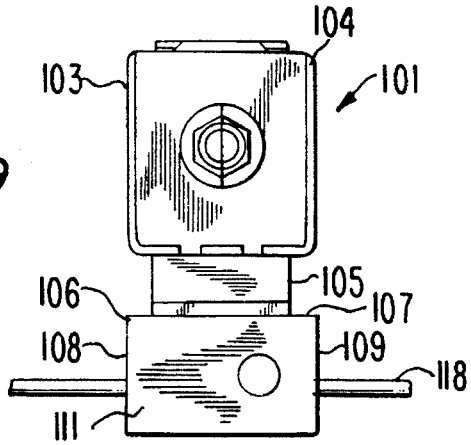

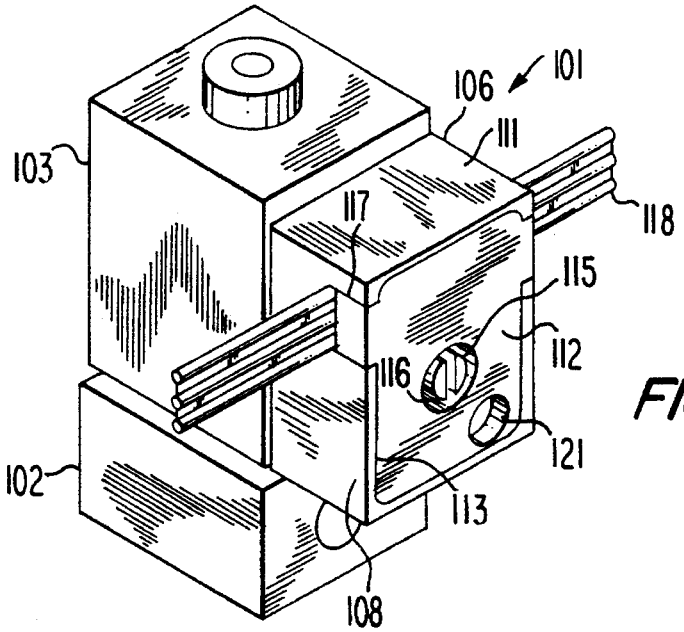
FIG. 10
FIG. 11
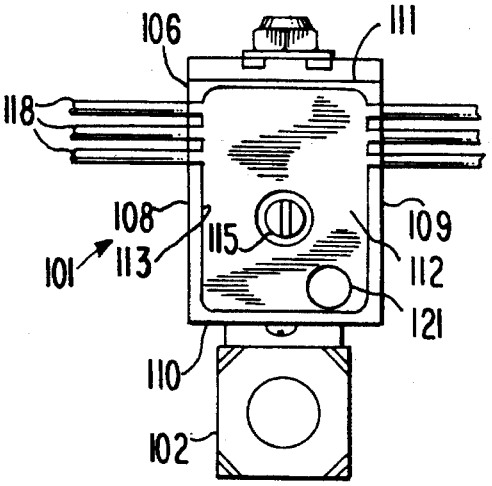
FIG. 12
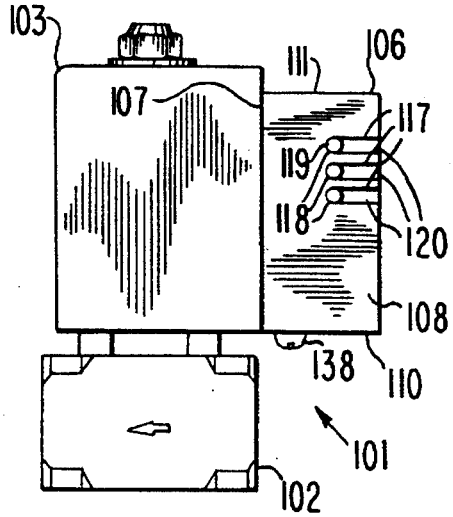
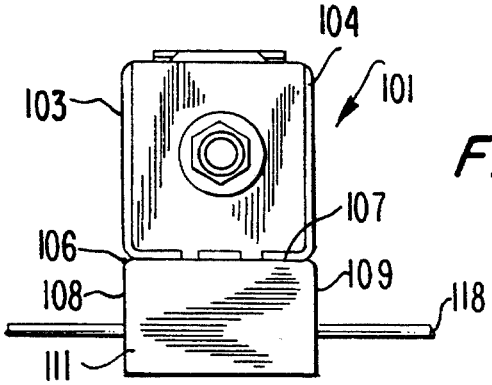
FIG. 13

ACTUATING DEVICE

BACKGROUND OF THE INVENTION

The present invention generally relates to an actuating device.

More particularly, it relates to a device for an electrically controllable actuator, in particular a magnetic valve which is connected with at least one control conductor.

Electrically controllable magnetic valves connected with a conventional electric conductor which supplies the magnetic head with voltage for actuation of the valve are known in the art. Such valve controls are relatively expensive and require substantial installation expenses.

SUMMARY OF THE INVENTION

Accordingly, it is an object of the present invention to provide a device which avoids the disadvantages of the prior art.

More particularly, it is an object of the present invention to provide a device which with simple means provides a rationally installable control connection for a single conductor or a multi-conductor bus system.

In keeping with these objects and with others which will become apparent hereinafter, one feature of the present invention resides, briefly stated, in a arrangement for an electrically controllable actuator, especially a magnetic valve, connectable with at least one control conductor, wherein in accordance with the present invention an electric actuator is associated with a through connection useable without a tool and arranged so that the control conductor uninterruptibly contacts with the through connection.

When the device is designed in accordance with the present invention, it eliminates the disadvantages of the prior art and achieves the specified highly advantageous results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing an inventive device with control conductors of a bus system provided in an upper housing part;

FIG. 2 is a plan view of the control conductor extending through the housing;

FIG. 6 is a general view of another device in accordance with the present invention;

FIG. 7 is a front view of the inventive device shown in FIG. 6;

FIG. 8 is a side view of the inventive device shown in FIG. 6;

FIG. 9 is a plan view of the inventive device shown in FIG. 1;

FIG. 10 is a general view of still a further device in accordance with the present invention;

FIG. 11 is a front view of the inventive device for FIG. 10;

FIG. 12 is a side view of the inventive device for FIG. 10;

FIG. 13 is a plan view of the inventive device for FIG. 10;

DESCRIPTION OF THE PREFERRED EMBODIMENTS

Figure 5:
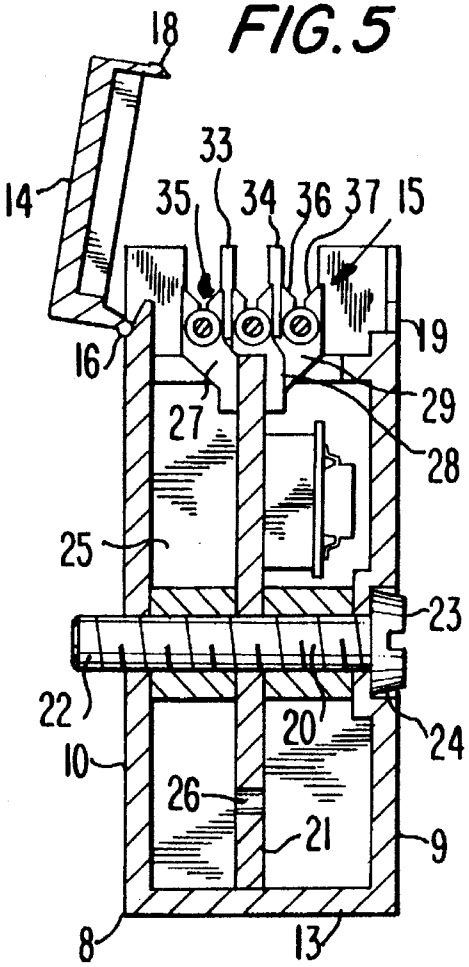
FIG. 5 is another sectioned view of the device of FIG. 3 with an open housing cover and an integrated mounting screw.
Figure 4:
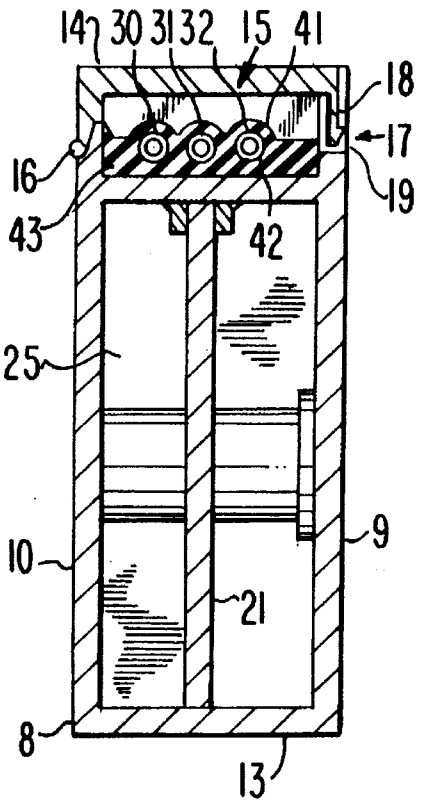
FIG. 4 is a sectioned side view of the of FIG. 3.
Figure 3:
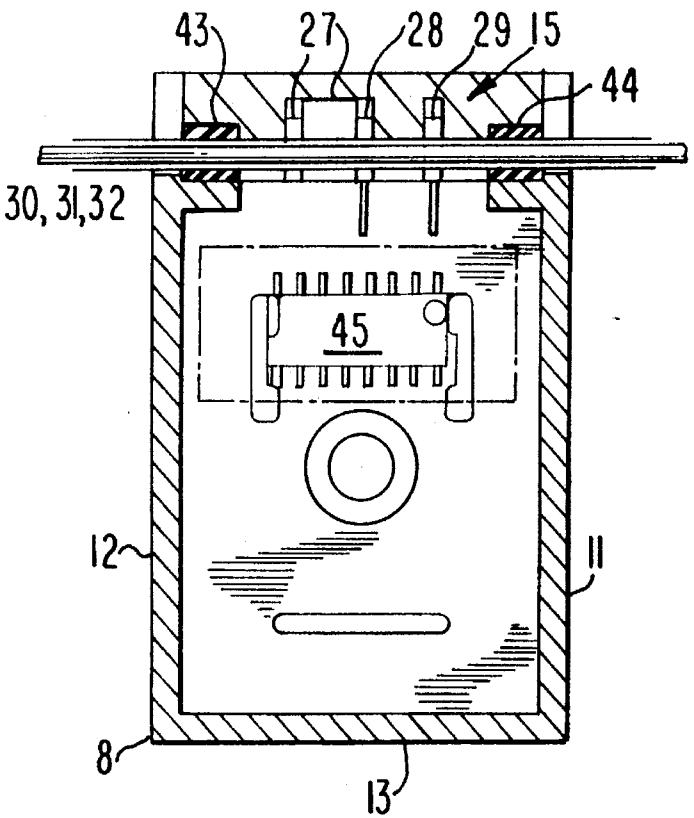
FIG. 3 is a front view of the inventive device with the control conductor extending through the housing in a section.

A device shown in FIG. 1 is identified with reference numeral 1 and has a valve 2 and an electromagnetic actuator arranged in the valve. The actuator can be provided with a not shown electric coil and electromagnetically displaceable armature.

A coupling part 4 is formed on one side of the actuator 3 so that for example the wire ends of the electric coil contact in the coupling part. For example three electric contact tongues 5, 6, 7 extend from the coupling 4 and can be provided preferably with a flat rectangular cross-section.

A housing 8 composed for example of synthetic plastic material can be arranged on the coupling part 4 of the actuator 3. The housing 8 is mounted releasably and plugged with the projecting contact tongues 5, 6, 7. The housing 8 can be substantially rectangular and is provided with a front wall 9, a rear wall 10, two side walls 11, 12, a bottom 13 and a cover 14. The cover 14 closes an upper part 15 of the housing 8 so that no dust or water can penetrate into the housing 8. For preventing losing of the cover 14, it can be advantageous to mount the cover 14 turnably on the rear wall 10 of the housing by a hinge 16. In accordance with a preferable embodiment, the hinge 16 is formed of one piece with the cover 14 and the housing 8 as a so-called film hinge. The closing of the cover 14 can be performed preferably by means of an integrated snap connection 17 which for example includes a projection 18 provided on the cover 4' and engageable into an opening 19 of the housing 8. The snap connection 17 can be provided preferably at the front wall 9 of the housing 8 located opposite to the hinge 16, so as to enable an unobjectionable easy access to it.

The housing 8 is mounted on the coupling part 4 by a screw 20 which extends through the front wall 9, a printed board 21 arranged in the housing 8, and the rear wall 10 of the housing and is screwed with a threaded end 22 in a corresponding nut thread of the coupling part 4. The screw 20 can have a head 23 which is supported in a recess 24 of the front wall 9 in a countersunk fashion. The printed board 21 which is arranged in a chamber 25 of the housing 8 between the front wall 9 and the rear wall 10 is substantially parallel to the walls and can extend from the bottom 13 to the upper part 15. It is provided with contact passages 26 arranged so that they contact with conductor tracks of the printed board 21 and the contact tongues 5, 6, 7 engage in the contact passages.

In the region of the upper part 15 of the housing preferably three through connections 27, 28, 29 are provided for a single or a multiple conductor bus system and contacted with respective control conductors 30, 31, 32. Insulating webs 33 and 34 can be provided for spacing the control conductors 30, 31, 32 from one another. For this purpose it is advantageous when the through connections 27, 28, 29 are arranged in the upper part 15 of the housing in the longitudinal direction of the control conductors 30, 31, 32 with a distance one behind the other and with the lateral offset relative to one another.

Each of the through connections 27, 28, 29 can be substantially U-shaped and provided with contact slot 35 limited by two opposite knife blade contacts 36, 37. In the upper region of the contact slot 35 an insertion opening 38 for the control conductors 30, 31, 32 can be formed. It is limited by two insertion inclines 39, 40 formed on the knife blade contacts 36, 37. For connecting the control conductors 30, 31, 32 they are simply pressed from above through the insertion opening 38 into the contact slot 35. The insulation 41 of the electrical conductor 42 is cut through by the knife blade contacts 36, 37 so that the knife blade contacts 36, 37 contact with the electrical conductor 42. The control conductors 30, 31, 32 is however not separated and as well known is connected with clamp contacts while the control conductors 30, 31, 32 contact without interruption with the through connections 27, 28, 29.

Moreover, it can be advantageous when a sealing member 43, 44 is respectively arranged in the upper part 15 of the housing 8 on the opposite side walls 11, 12, so that the control conductors 30, 31, 32, can be tightly surrounded by the sealing members and no impurities can penetrate into the housing 8.

The conductor tracks of the printed conductor board 21 contact with the contact tongues 5, 6, 7 and the through connections 27, 28, 29. The chamber 25 which accommodates the printed board 21 can also contain a control module 45 provided between the contact tongues 5, 6, 7 of the actuator 3 and the through connections 27, 28, 29. The control module 45 can evaluate the signals received through the control conductors 30, 31, 32 and supply the signals to the actuator 3 or when needed through the control conductors 30, 31, 32 to one or more further actuating devices.

In the shown embodiment, the through connections 27, 28, 29 for the control conductors 30, 31, 32 and the control module 45 provided on the printed board 21 are assembled as a nut in the housing 8 which advantageously can be plugged on the contact tongues 5, 6, 7. This pluggable unit can be formed as an adaptor mountable later on the actuator 3, so that it can be equipped with such an adaptor at any time.

In accordance with another embodiment which is not shown in the drawings, it can be advantageous when the through connections 27, 28, 29 are already fixedly mounted on the actuator 3 or integrated in it in a factory. Moreover, it can be advantageous when the control module 45 is provided already on the actuator 3 so as to form a compact prefabricated unit.

An important advantage of the inventive arrangement is that a bus control is produced with a connection box for example for two-conductor technique, and the control conductors can be installed uninterruptingly with simple means manually.

The device in accordance with the embodiment shown in FIGS. 6–9 and identified with reference numeral 101 has a valve 102 with an electromagnetic actuator 103 having an actuator housing 104 which can accommodate a not shown electric coil and an electromagnetically displaceable armature.

A coupling part 105 can be arranged on one side of the actuator 103. It can be inserted into a recess of the actuator housing 104 and provided with contacts for wire ends of the electric coil and preferably with three projecting flat-rectangular contact tongues.

A housing 106 composed for example of a synthetic plastic material can be plugged on the coupling part 105 and has a substantially rectangular shape. It can have a rear wall 107, two side walls 108, 109, a bottom 110, an upper wall 111 and a releasable cover wall 112 which forms a front wall of the housing. The cover wall closes a housing opening 113, provided on a front side of the housing 106 which is remote from the actuator 103. The housing 106 can be releasably mounted on the coupling part 105 by a screw 114. The screw engages in a nut thread of the coupling part 105 and its head 115 preferably supported in a recess 116 of the cover wall 112 in a countersunk manner.

Opposite located recesses 117 can be formed preferably in the side walls 108, 109. They are substantially rectangular and adjoin the housing opening 113, so that the recesses 117 are limited at three sides and are open from the front in the plane of the housing opening 113 with the removable cover wall 112. When the cover wall 112 is removed, a control conductor 118 can be inserted in the recesses 113, It can be formed single-wire for a single conductor bus system or three-wire for a multi-conductor bus system as designed as a flat conductor cable. For the utilization of a multi-wire flat conductor cable the recess 117 can be formed so that it width is approximately equal to the width of the flat conductor cable. Troughs 119 can be formed on the base of the recesses 117 and the convex rounds of the control conductor 118 can be engaged in the troughs in a form-locking manner.

On the removable cover wall 112 on its opposite sides, preferably rectangular projections 120 can be formed an engage in the recesses 117. Preferably the end sides of the projections 112 which face the control conductor 118 can be also provided with such troughs 119. The convex rounds of the control conductor 118 form-lockingly engage in the troughs 119 so as to provide a tight closure and a reliable hold of the control conductor 118.

As can be seen from FIGS. 6, 7 and 9, an adjusting member 121 can be provided on the upper wall 111 of the housing 106. An addressing switch 140 supported in the housing 106 as shown in FIG. 12 can be adjusted by the adjusting member 121 from outside without removing of the cover wall 112.

The device in accordance with the embodiment shown in FIGS. 10–17 differs from the embodiment of FIGS. 6–9 substantially in that no coupling part 105 is provided between the actuator 103 and the housing 106 to form a distance therebetween. The housing 106 abuts directly against the actuator 103 so as to form a compact unit. The housing 106 can be integrated directly on the actuator housing 104 and will be removably connected with it. For this purpose, the housing 106 on its rear wall 107 can be provided with one or several holding webs 122 insertable in a recess 123 of the actuator housing 104 and engageable with the wall of the actuator housing 104 as shown in FIG. 9.

Figure 16:
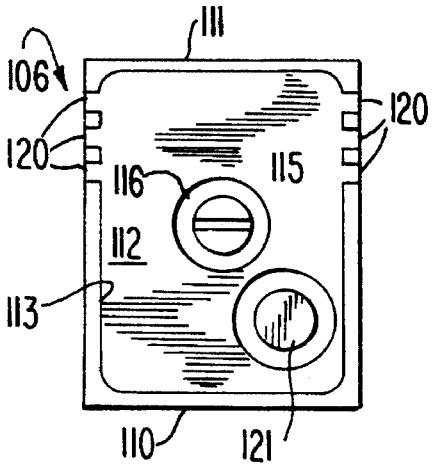
FIG. 16 is a front view of a housing connected with a device of FIG. 14.
Figure 17:
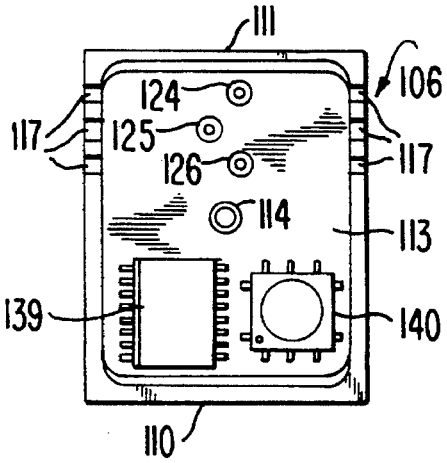
FIG. 17 is a view showing the housing of the inventive device of FIG. 16 with a removed front cover wall.

As can be seen from FIGS. 10, 11 and 16, the adjusting member 121 for the addressing switch 140 is provided in this case not on the upper wall 111 but instead of the removable cover wall 112. Therefore the adjustment of the addressing switch 140 can be performed from the front side.

As shown in FIGS. 11 and 12, for the use of several one-wire control conductors 118 it can be favorable when the recess 117 is formed for example by three small slots so that an individual conductor can be inserted in each slot. A trough 119 for receiving the convex round of the control conductor 118 can be formed in the bottom of the slot. Three web-shaped small projections 120 can be formed for example on the removable cover wall 112 at opposite sides and engage in the slot-shaped recesses 117. For this purpose it is advantageous when the end side of each projection 120 facing the control conductor 118 is provided with a trough 119, in which the convex round of the control conductor 118 engages in a form-locking member. Therefore for each individual bus conductor 118 a reliable holding and tight housing closure is provided.

As can be seen from FIGS. 14–17, three through connections 124, 125, 126 can be provided in the housing 106. A conductor of the control conductor 118 can electrically contact each throughgoing connection 124, 125, 126. For arranging the individual conductors of the control conductor 118 at a distance from one another, it can be favorable to arrange the through connections 124, 125, 126 which are preferably supported in the upper part of the housing 106 by the screw 114, with a lateral offset relative to one another in the longitudinal direction of the control conductor 118.

Each through connection 124, 125, 126 can be substantially U-shaped and provided with a contact slot 127 limited by two opposite knife blade contacts 128, 129. An insertion opening 130 can be formed at the free end of the contact slot 127 and limited by two insertion inclines formed on the knife blade contacts 128, 129. For connecting the control conductor 118 the respective conductor is pressed through the insertion opening 130 into the contact slot 127. The insulation of the conductor is cut through by the knife blade contact 128, 129 so that the latter contact with the electrical conductors. The control conductor 118 is however not separated, but instead contact without interruption with the through connections 124, 125, 126.

A printed board 131 can be provided in the housing 106. Preferably it is supported at a distance parallel to the plane of the rear wall 107 and limited by the side walls 108, 109 as well as by the bottom 108 and the upper wall 111. A pin 132 can be formed substantially in the center of the housing 106 on the rear wall 107 and a counter pin 133 can be formed on the cover wall 112 so that printed board 131 can be held between them. The through connections 124, 125, 126 can be mounted preferably on the printed board 131 so that the insertion opening 130 of the contact slot 127 faces the housing opening 113 or the cover wall 112 and is located in the plane of the recesses 117 or slots formed in the side walls 108, 109.

At least one contact 134 for a connection 135 of an electric coil 136 of the actuator 103 can be arranged on the printed board 131. Moreover, a magnetic closing disc 137 of the actuator 103 can be mounted under the bottom 110 of the housing 106 by a contact screw 138. Further, it can be favorable for the system control when an integrated circuit 139 and the address switch 140 are provided on the printed board 131 and supported preferably in the lower part of the housing 106.

Figure 14:
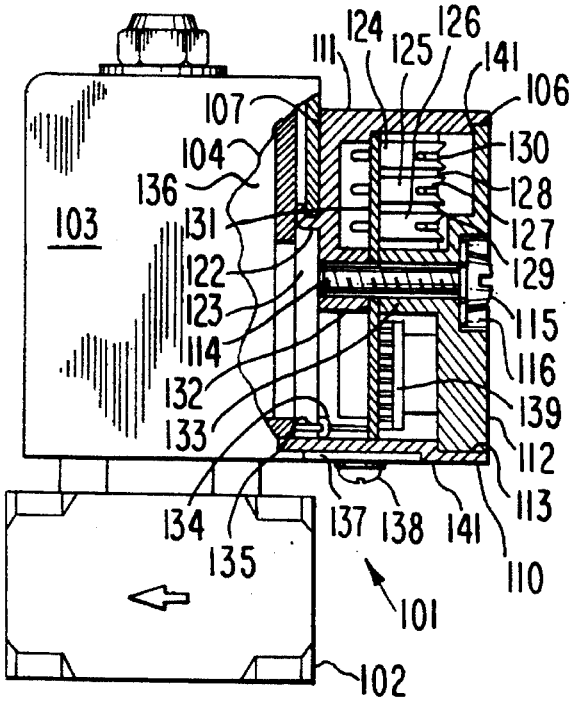
FIG. 14 is a partially sectioned view of the device of FIG. 12 on an enlarged scale.
Figure 15:
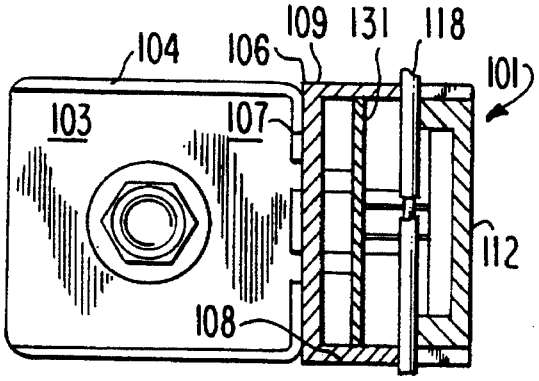
FIG. 15 is a partially sectioned plan view of the inventive device of FIG. 14.

As can be seen from FIG. 14 the screw 114 extends through an opening of a counter pin 133 formed on the cover wall 112 and has a free end engaging in a nut thread formed in the rear wall 107 or in the pin 132. During tightening of the screw 114 the housing opening 113 is tightly closed by the cover wall 112, and the latter abuts against projections 141 of the housing 106.

Figure 18:
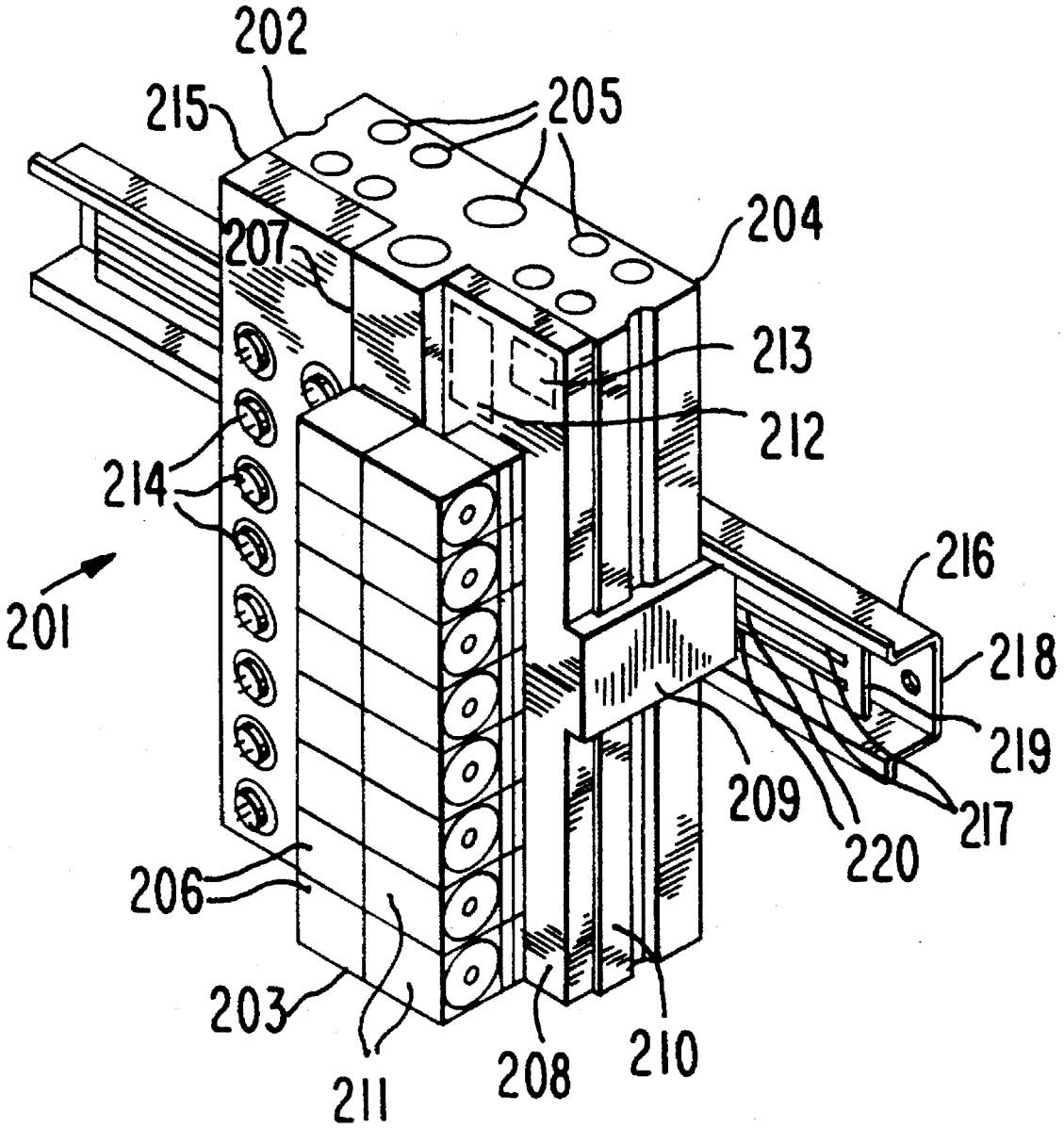
FIG. 18 is a general view of a device in accordance with a further embodiment.

The inventive arrangement 201 shown in FIG. 18 has a substantially rectangular distributor 202 with preferably eight magnetic valves 203 arranged in series closely near one another on the front side of the distributor. Therefore a space saving integral compact module 204 is formed.

A plurality of medium-guiding passages can be provided in the distributor 202 and conductor connections 204 arranged at the upper end side of the distributor 202 can be associated with the passages. The conductor connections 105 serve for connection with not shown hose or tubular conduits in which the medium, for example air, is supplied. The valve body 206 of the magnetic valve 203 can be preferably removably mounted on a web-shaped projection 207 projecting from the front side of the distributor 202 and connected with the passages of the distributor 202.

Moreover, a contact rail 208 extending parallel to the projection 207 can be provided on the front side of the distributor 202. It has a contact web 209 which is arranged on a longitudinal side 210 of the distributor 202 and extends at the rear side opposite to the front side. The actuator 211 which is connected with the valve body 206 and formed for example as electromagnetic head, can be plugged on the contact rail 208 to provide an electrical contacting for a bus control.

It is preferable to provide an integrated switching circuit 212 and an addressing switch 213 which can be supported preferably on or in the contact rail 208 and permit an individual control of the magnetic valve 203 through the bus system. Moreover, a device plug 214 can be provided for the connection of the sensors. It is associated with the magnetic valves 203 and can be arranged at the front side of the distributor 202 on the rail 215 located at the side opposite to the contact rail 208 and parallel near the projection 207.

The compact module 204 can be mounted on a mounting rail 216 with the side of the distributor 202. The mounting rail 216 can have a substantially hat-shaped cross-section. For example a three-wire bus control conductor 217 can be supported inside the mounting rail 216 so as to be protected. Preferably it extends continuously uninterruptingly near the base wall 218 of the mounting rail 216 and preferably arranged on a supported wall 219 extending parallel to the base wall 218.

A part of the contact web 209 which extends over the distributor 202 can be provided with through connection 220. The connection contacts with the control conductor 217 uninterruptingly so that during mounting or plugging of the distributor 202 on the opening side opposite to the base wall 218, the mounting rail 216 provides automatically, without pressure manipulations, the contacting of the through connection 220 with the control conductor 217. For this purpose, two contact knife blades of the U-shaped through connection 220 surround the wire of the control conductor 217. The contacting is performed also inside the hat-shaped profile of the mounting rail 216. Therefore a fast mounting of several magnetic valves 203 assembled to form a small contact module 204 and the reliable contacting of the bus control system are provided.

It will be understood that each of the elements described above, or two or more together, may also find a useful application in other types of constructions differing from the types described above.

While the invention has been illustrated and described as embodied in an actuating device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An actuating device, comprising an actuator; at least one control conductor connected with said actuator; at least one through connection useable without a tool and associated with said electrical actuator, said control conductor uninterruptibly contacting with said through connection, said actuator having an electric coil with a connection and a magnetic closing disc; and a printed board arranged in said housing and provided with a contacting for said connection of said electrical coil.

2. An actuating device as defined in claim 1, wherein said through connection is a component of said actuator.

3. An actuating device as defined in claim 1; and further comprising a housing having an opening, a rear wall and a cover wall closing said housing, said cover wall being held on said housing by a releasable screw, said actuator having a coupling part, at least one of said coupling part and said actuator engaging said rear wall of said housing.

4. An actuating device as defined in claim 1; and further comprising a housing accommodating said through connection, and having a housing rear wall provided with at least one holding web, said actuator having an actuator housing provided with a recess and a wall, said housing being fixable by insertion into said recess of said actuator housing, and said holding web of said housing rear wall engaging said rear wall of said actuator housing.

5. An actuating device as defined in claim 1; and further comprising a housing insertable in said actuator housing and accommodating said through connection, said housing having a bottom on which said magnetic closure disc of said actuator is arranged.

6. An actuating device as defined in claim 1, wherein said actuator has contacts; and further comprising a control module connected between said contact of said actuator and said through connection for evaluating signals received through said control conductor.

7. An actuating device as defined in claim 6, wherein said control module is a component of said actuator.

8. An actuating device as defined in claim 6; and further comprising a housing accommodating said through connection and said control module.

9. An actuating device as defined in claim 8, wherein said housing has a first chamber and an upper part, said control module being arranged in said first chamber, while said through connection is arranged in said upper part of said housing.

10. An actuating device as defined in claim 9, wherein a plurality of said through connections is arranged in said upper part of said housing, said through connections being located one behind the other in a longitudinal direction of said control conductor and laterally offset relative to one another, said upper part of said housing being also provided with insulating webs.

11. An actuating device as defined in claim 1, wherein said through connection is substantially U-shaped and has a contact slot limited by knife-blade contacts, said control conductor having an electrical conducting member received in said contact slot and an insulation which is cut through by said knife blade contacts.

12. An actuating device as defined in claim 11, wherein said contact slot of said through connection has an insertion opening provided for said control conductor and limited by insertion inclines formed on said knife blade contacts.

13. An actuating device as defined in claim 9, wherein said upper part of said housing has a sealing member which surrounds said control conductor.

14. An actuating device as defined in claim 13, wherein said sealing member is arranged at two opposite sides of said housing.

15. An actuating device as defined in claim 13, wherein said upper part of said housing surrounds said through connection and said sealing member and is provided with a closing cover for protecting from dust and water penetration.

16. An actuating device as defined in claim 9, wherein said a printed board is located in said chamber, said control module being arranged on said printed board, said printed board contacting with said through connection.

17. An actuating device as defined in claim 16, wherein said housing accommodates said through connection, said printed board and said control module and is releasably mounted on said actuator.

18. An actuating device as defined in claim 17, wherein said printed board has conductor tracks leading to at least one of said control module and said through connection, said housing being pluggable on said contacts of said actuator so said contacts of said actuator contact said conductor tracks of said printed board.

19. An actuating device as defined in claim 17; and further comprising a screw which secures said housing on said actuator.

20. An actuating device as defined in claim 19, wherein said actuator has a coupling part which supports said contact of said actuator, said screw extending through said housing and through said printed board and has a threaded end screwed into said coupling part.

21. An actuating device as defined in claim 1; and further comprising a housing which accommodates said through connection and has a front side which is remote from said actuator and provided with an opening closeable by a cover wall which forms a front housing wall, said housing having side walls provided with at least one recess which adjoins said housing opening and receives said control conductor.

22. An actuating device as defined in claim 21, wherein said control conductor is a multi-wire flat-band conductor having a predetermined width, said recess in said side walls of said housing having a width substantially corresponding to the width of said conductor.

23. An actuating device as defined in claim 21, wherein said control conductor is formed as a single-wire conductor, said recess being formed as a small slot in which said one-wire control conductor is supported.

24. An actuating device as defined in claim 21, wherein said control conductor includes a plurality of single-wire conductors, said recess being formed as a plurality of small slots in which said single-wire conductors are supported.

25. An actuating device as defined in claim 21, wherein said cover wall having at least one projection which at least partially closes said recess.

26. An actuating device as defined in claim 11; and further comprising a housing accommodating said through connection and having a housing opening closeable by a cover wall and side walls provided with at least one recess for said control conductor, said contact slot between said knife blade contacts having an insertion opening which faces said housing opening.

27. An actuating device as defined in claim 26, wherein said insertion opening is provided in a plane of said recess.

28. An actuating device as defined in claim 1; and further comprising a housing accommodating a plurality of said through connections and having a cover wall, said through connections being arranged in a housing at a distance from one another and laterally offset relative to one another.

29. An actuating device as defined in claim 28, wherein said printed board is arranged parallel to said cover wall, said through connections being mounted on said cover wall.

30. An actuating device as defined in claim 1; further comprising a housing accommodating said through connection; an integrated switching circuit; and an address switch, at least one of said integrated switching circuit and said address switch being supported in said housing.

31. An actuating device as defined in claim 28 and further comprising a printed board arranged in said housing, and contacting at least one of said switching circuit and said address switch.

32. An actuating device, comprising an actuator; at least one control conductor connected with said actuator; at least one through connection useable without a tool and associated with said electrical actuator, said control conductor uninterruptibly contacting with said through connection; and a distributor provided with a device plug for connecting two sensors.

33. An actuating device as defined in claim 32, wherein said distributor has a contact rail, said device plug being arranged on a rail and electrically connected with said contact rail.

34. An actuating device, comprising an actuator; at least one control conductor connected with said actuator; at least one through connection useable without a tool and associated with said electrical actuator, said control conductor uninterruptibly contacting with said through connection; a distributor; and a mounting rail, said through connection automatically electrically contacting with said control conductor by placing said distributor on said mounting rail.

35. An actuating device as defined in claim 34, wherein said mounting rail has a base wall and an opposite opening side, said mounting rail having a hat-shaped cross-section, said control conductor being arranged near said base wall of said mounting rail, said distributor being arranged at said opening side of said mounting rail.

36. An actuating device, comprising an actuator; at least one control conductor connected with said actuator; at least one through connection useable without a tool and associated with said electrical actuator, said control conductor uninterruptibly contacting with said through connection, said actuator having contacts; a control module connected between said contact of said actuator and said through connection for evaluating signals received through said control conductor; and a housing accommodating said through connection and said control module, said housing having a first chamber and an upper part, said control module being arranged in said first chamber, while said through connection is arranged in said upper part of said housing, said upper part of said housing having a sealing member which surrounds said control conductor, said upper part of said housing surrounding said through connection and said sealing member and being provided with a closing cover for protecting from dust and water penetration, said cover being supported on said upper part of said housing through a hinge and held in a closed position by a releasable snap connection.

37. An actuating device, comprising an actuator; at least one control conductor connected with said actuator; at least one through connection useable without a tool and associated with said electrical actuator, said control conductor uninterruptibly contacting with said through connection; a housing accommodating said through connection; an integrated switching circuit; an address switch, at least one of said integrated switching circuit and said address switch being supported in said housing; said housing having a front cover wall and an upper wall; and an adjusting member provided for said address switch and arranged in one of said walls.

38. An actuating device, comprising an actuator; at least one control conductor connected with said actuator; at least one through connection useable without a tool and associated with said electrical actuator, said control conductor uninterruptibly contacting with said through connection; and a housing which accommodates said through connection and has a front side which is remote from said actuator and provided with an opening closeable by a cover wall which forms a front housing wall, said housing having side walls provided with at lest one recess which adjoins said housing opening and receives said control conductor, said control conductor being a multi-wire flat-band conductor having a predetermined width, said recess in said side walls of said housing having a width substantially corresponding to the width of said conductor, said housing having a recess, said cover wall being arranged in said housing opening in a countersunk manner and supported in said recess of said housing.

* * * * *